US005338109A

United States Patent [19]

Haines

[11] Patent Number: 5,338,109

[45] Date of Patent: Aug. 16, 1994

[54] HAND GUN SAFETY STORAGE CABINET

[76] Inventor: Raymond Haines, 634 Fairview La., Forked River, N.J. 08731

[21] Appl. No.: 5,216

[22] Filed: Jan. 15, 1993

[51] Int. Cl.[5] ..... E05C 7/06; E05B 65/52

[52] U.S. Cl. ..... 312/222; 312/215; 70/423

[58] Field of Search ..... 312/215, 329; 70/423

[56] References Cited

U.S. PATENT DOCUMENTS

| | | | |
|---|---|---|---|
| 1,608,456 | 11/1926 | Abdouch | 312/128 |
| 1,925,199 | 9/1933 | Mills | 312/215 X |
| 2,554,362 | 5/1951 | Ferguson | 312/329 |
| 2,610,473 | 9/1952 | Chovanec | 312/329 |
| 2,821,451 | 1/1958 | Kaufman | 312/139.2 |
| 2,858,408 | 10/1958 | Barroero | 312/139.2 X |
| 4,066,307 | 1/1978 | Barding | 312/215 X |
| 4,303,288 | 12/1981 | Aschinger | 312/215 |
| 5,085,491 | 2/1992 | Lautenschläger | 312/329 |

*Primary Examiner*—Kenneth J. Dorner
*Assistant Examiner*—Nancy Mulcare
*Attorney, Agent, or Firm*—E. Michael Combs

[57] ABSTRACT

A housing container includes a front door plate employing spring hinges is hingedly mounted relative to the housing container, wherein the door plate includes a latch plate having a plurality of lock levers to be operated simultaneously and each independently pivotally mounted relative to an interior surface of the door plate, with the lock levers accessed through individual openings directed through the door plate. Upon displacement of the lock levers relative to a sliding lock plate, the lock plate is displaced relative to a latch flange portion within the container by displacement of a lock plate lug slidably mounted through a slot directed through the door plate below the access openings.

7 Claims, 7 Drawing Sheets

HAND GUN SAFETY STORAGE CABINET

BACKGROUND OF THE INVENTION

1. Field of the Invention

The field of invention relates to child proof container structure, and more particularly pertains to a new and improved child proof storage housing wherein the same requires manual dexterity in the displacement and opening of a locking mechanism relative to the housing structure.

2. Description of the Prior Art

Child proof containers have been utilized in the prior art and exemplified in the U.S. Pat. No. 3,780,547 to Drumheller wherein reliance upon length of an individual's fingers to release a latch mechanism is provided, wherein the instant invention overcomes such deficiencies by requiring a two-handed manipulation of the locking mechanism of the organization preventing access relative the container's cavity.

U.S. Pat. Nos. 4,286,808; 4,111,505; 4,008,934; and 4,715,628 are further examples of child resistant closure structures, wherein the instant invention overcomes deficiencies of the prior art by providing manual dexterity and two-handed operation in the opening and access within a storage housing and in this respect, the present invention substantially fulfills this need.

SUMMARY OF THE INVENTION

In view of the foregoing disadvantages inherent in the known types of child proof container structure now present in the prior art, the present invention provides a hand gun safety storage cabinet wherein the same utilizes lock levers in cooperation with a lock plate lug to permit unlatching of a door mechanism relative to a housing. As such, the general purpose of the present invention, which will be described subsequently in greater detail, is to provide a new and improved child proof storage housing which has all the advantages of the prior art child proof storage containers and none of the disadvantages.

To attain this, the present invention provides a housing container including a front door plate employing spring hinges is hingedly mounted relative to the housing container, wherein the door plate includes a latch plate having a plurality of lock levers to be operated simultaneously and each independently pivotally mounted relative to an interior surface of the door plate, with the lock levers accessed through individual openings directed through the door plate. Upon displacement of the lock levers relative to a sliding lock plate, the lock plate is displaced relative to a latch flange portion within the container by displacement of a lock plate lug slidably mounted through a slot directed through the door plate below the access openings.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hand gun safety storage cabinet which has all the advantages of the prior art child proof storage containers and none of the disadvantages.

It is another object of the present invention to provide a new and improved hand gun safety storage cabinet which may be easily and efficiently manufactured and marketed.

It is a further object of the present invention to provide a new and improved hand gun safety storage cabinet which is of a durable and reliable construction.

An even further object of the present invention is to provide a new and improved hand gun safety storage cabinet which is susceptible of a low cost of manufacture with regard to both materials and labor, and which accordingly is then susceptible of low prices of sale to the consuming public, thereby making such hand gun safety storage cabinets economically available to the buying public.

Still yet another object of the present invention is to provide a new and improved hand gun safety storage cabinet which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
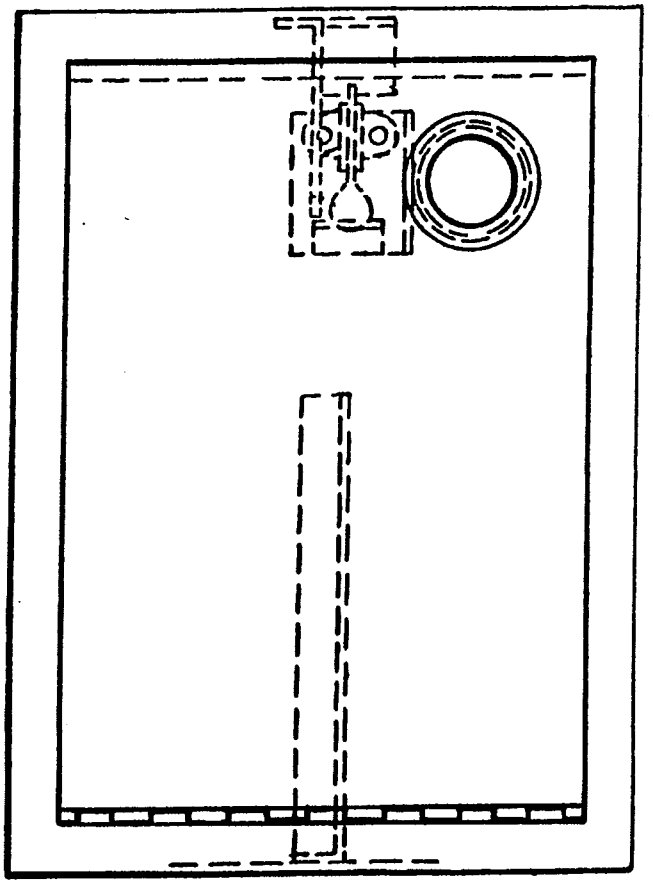
FIG. 2 PRIOR ART
FIG. 2 is an orthographic exterior view of the door and latch mechanism relative to the U.S. Pat. No. 3,780,547 as indicated in FIG. 1.
Figure 1:
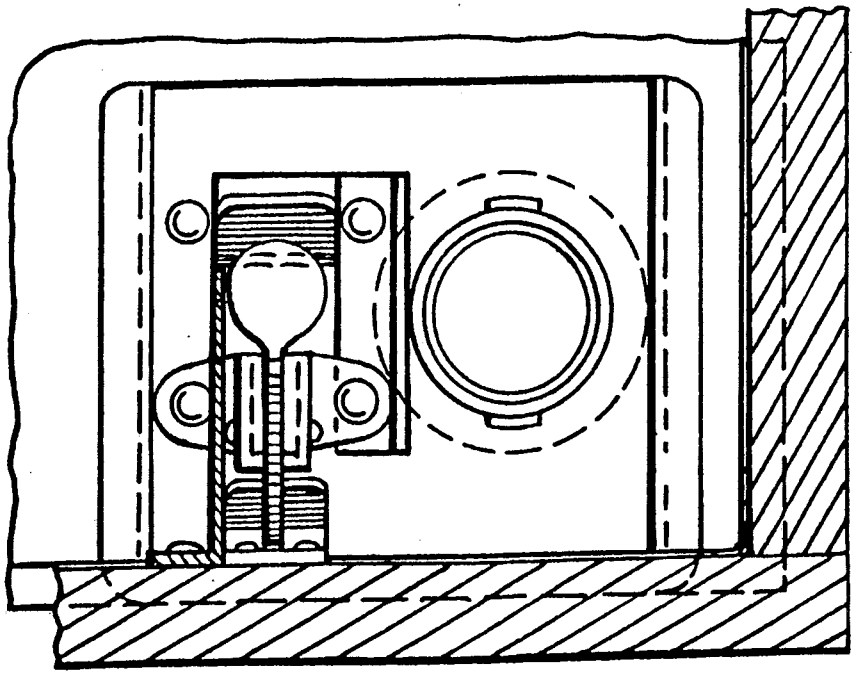
FIG. 1 PRIOR ART
FIG. 1 is an orthographic view of a latch mechanism, as indicated in U.S. Pat. No. 3,780,547.
Figure 3:
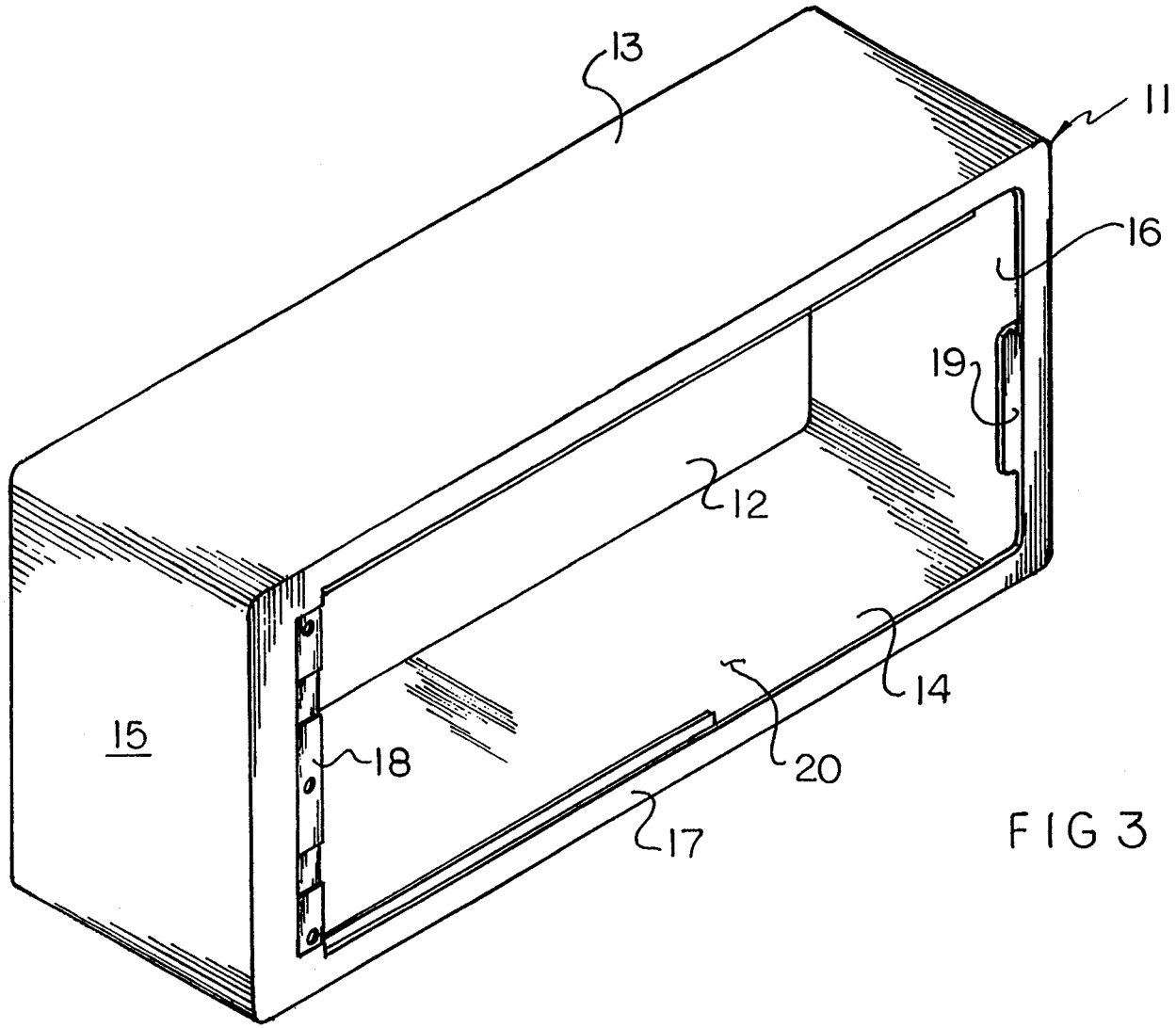
FIG. 3 is an isometric illustration of the container structure of the invention.
Figure 5:
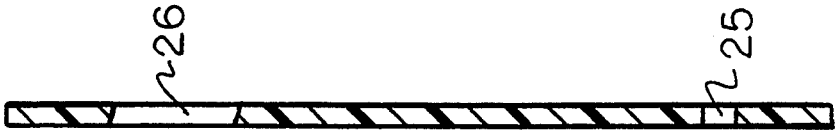
FIG. 5 is an orthographic view, taken along the lines 5—5 of FIG. 4 in the direction indicated by the arrows.

With reference now to the drawings, and in particular to FIGS. 1 to 10 thereof, a new and improved hand gun safety storage cabinet embodying the principles and concepts of the present invention and generally designated by the reference numeral 13 will be described.

Figure 4:
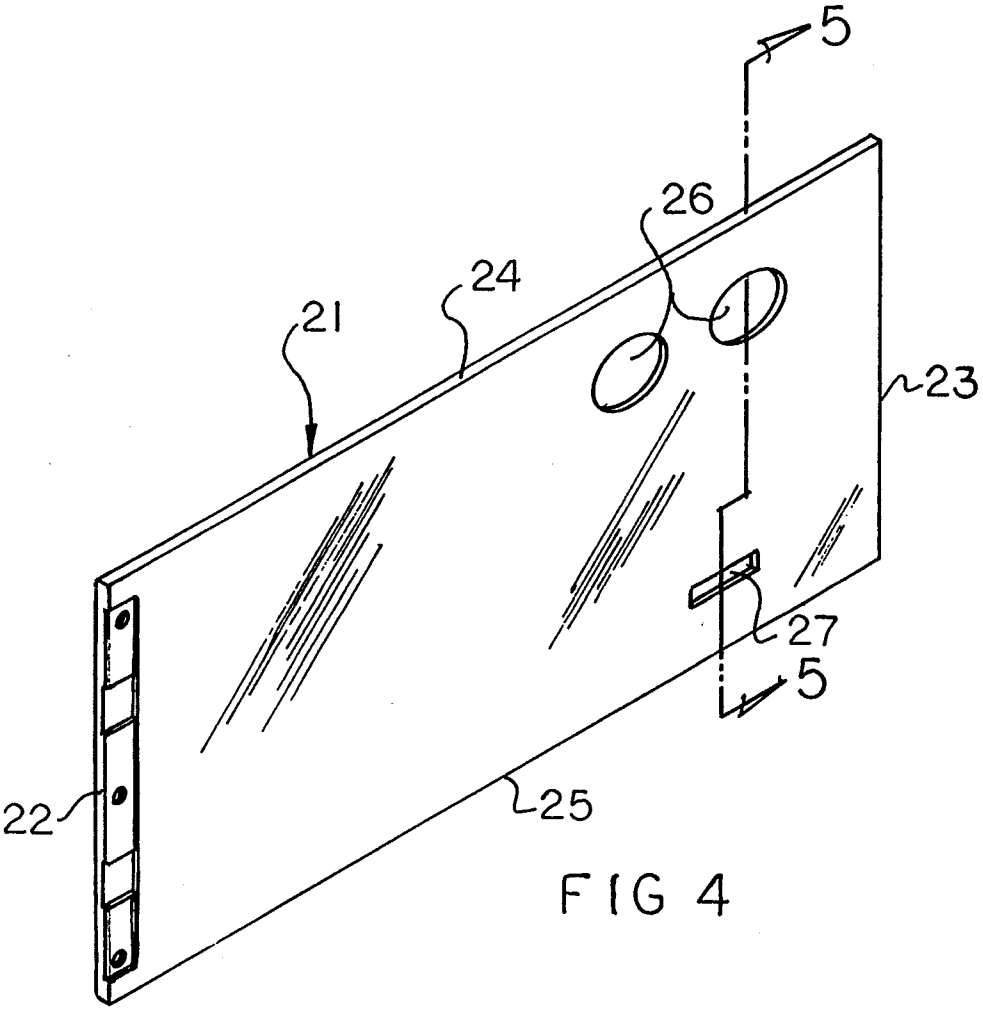
FIG. 4 is an isometric illustration of the door plate structure of the invention.
Figure 7:
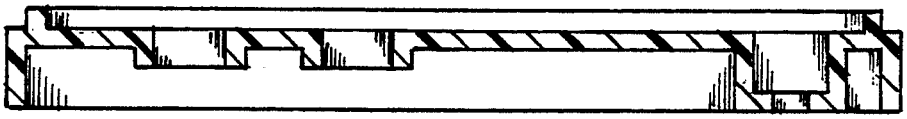
FIG. 7 is an orthographic view, taken along the lines 7—7 of FIG. 6 in the direction indicated by the arrows.

More specifically, the hand gun safety storage cabinet 10 of the instant invention essentially comprises a container 11 having a container rear wall 12, a top wall 13, a floor 14, and spaced first and second side walls 15 and 16 respectively. A front wall continuous perimeter flange 17 is formed to have a front wall opening 20 therethrough, with the perimeter flange having a hinge plate 18 extending into the opening 20 from the first side wall 15 and a latch flange 19 extending into the opening 20 relative to the second side wall 16 in adjacency thereto. A door plate 21 is provided having a door plate first end 22 mounted to the hinge plate 18 to permit pivoting of the door plate relative to the container 11. The door plate includes a door plate second end 23 to overlie the latch flange 19, as well as the perimeter flange in a first position when the door plate is in contiguous communication with the latch flange and to permit spacing of the door plate relative to the latch flange 19 when the door plate is pivoted about the hinge plate 18 spacing the door plate relative to the perimeter flange 17. The hinge plate 18 is typically arranged to utilize spring hinges to bias the door plate 21 in a latched orientation to the container 11. The door plate 21, as indicated in FIG. 4, includes a door plate first side 24 spaced from a door plate second side 25. A plurality of finger access openings 26 are directed through the door plate in adjacency to the first side 24 and the door plate second end 23. A door plate slot 27 is directed through the door plate 21 parallel to the second side 25 medially between and spaced from the access openings 26.

Figure 6:
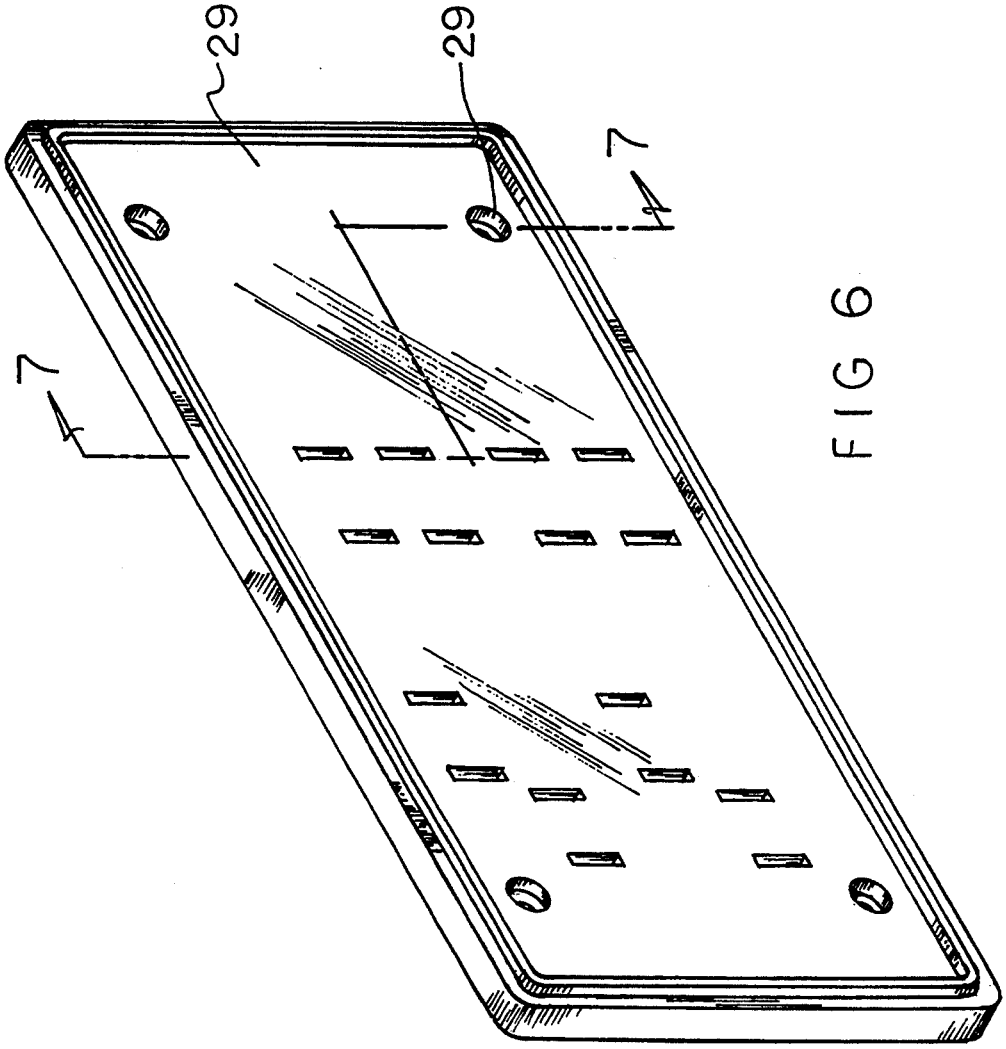
FIG. 6 is an isometric illustration of the mounting plate rear wall structure of the container of the invention.

The FIG. 6 indicates the use of a container mounting plate 28 that may be integral with or as a separate plate structure relative to the rear wall 12. For example, the mounting plate 28 may be utilized in lieu of the rear wall 12 integrally formed to the container 11, having mounting plate apertures 29 directed therethrough for ease of securement of the container 11 relative to a convenient support, either in a vertical or horizontal orientation as desired.

Figure 8:
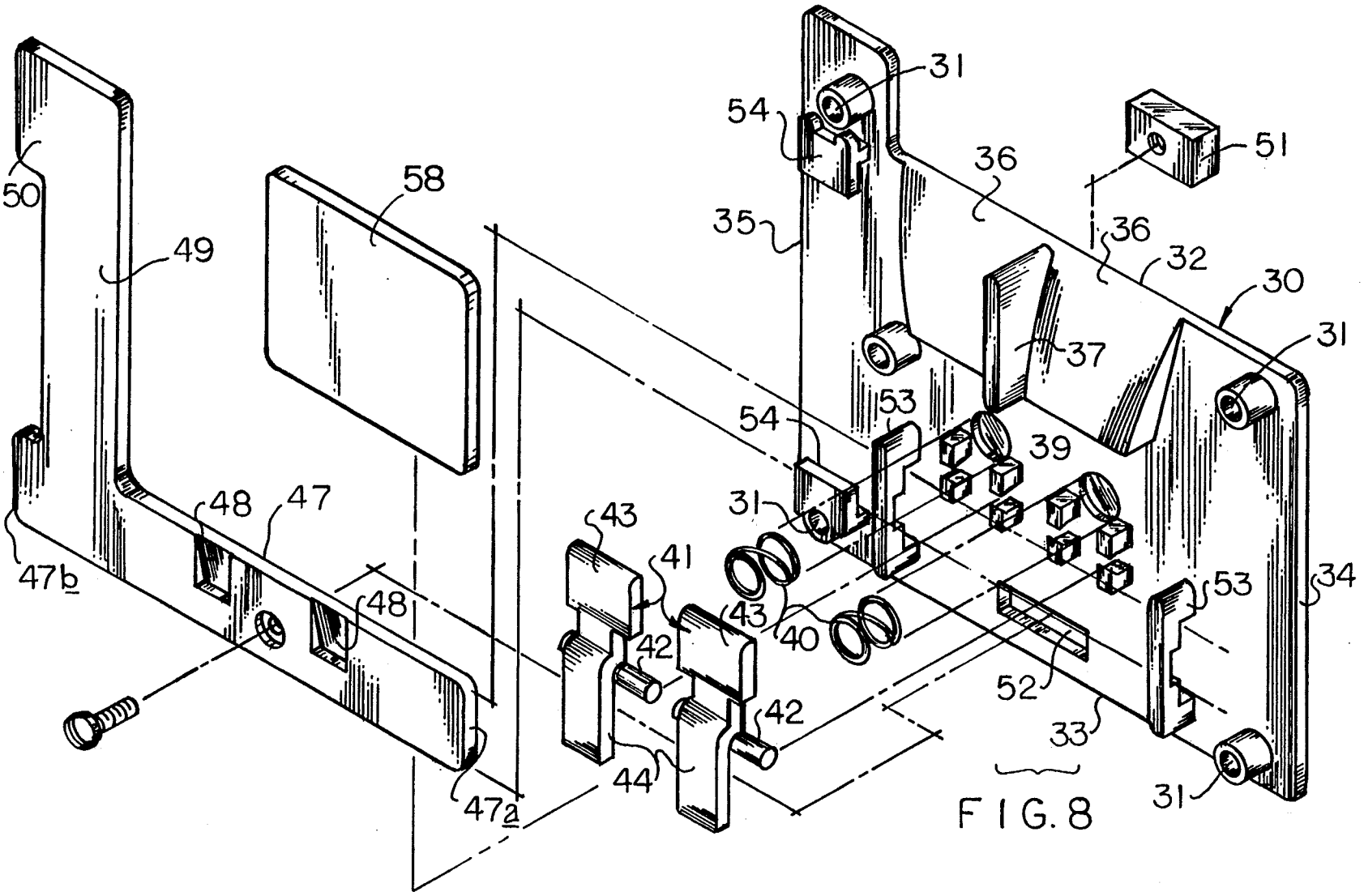
FIG. 8 is an isometric exploded view of the latch plate structure of the invention.

The FIG. 8 indicates the latch plate mechanism 30 employed by the invention that is oriented between the finger access openings 26 and the door plate second side 25. The latch plate 30 may be integrally mounted to an interior surface of the door plate 21, or alternatively as a separate member having mounting apertures 31 to permit mechanical fastening of the latch plate 30 relative to the door plate 21. The latch plate includes a latch plate first side 32 parallel to and below the door plate first side 24, with a latch plate second side 33 spaced from the door plate second side 23. The latch plate includes a latch plate first end 34 oriented in adjacency to and parallel the door plate first end 22, with a door plate second end 35 parallel to and spaced from the door plate second end 23.

A plurality of spaced guide ramps 36 are provided, with one of the guide ramps 36 oriented below an associated access aperture 26, with each guide ramp 36 canted from the latch plate first side 32 to position above the latch plate, with the guide ramps 36 having a partition wall 37 oriented medially of the guide ramps 36 and medially below the access apertures 26. The partition wall 37 enhances ease of guidance and displacement of an individual's fingers that are directed through the access apertures 26 to guide the fingers onto the lock levers 41, as indicated in FIG. 10 for example.

A plurality of spring positioning recesses 39 are provided, with one below each of the guide ramps 36. The lock levers 41, as noted above, are arranged in a parallel relationship relative to one another, and parallel relative to the partition wall 37. The lock levers 41 are pivotally mounted about lock lever axles 42 that are mounted to the latch plate 30, one below each of the spring positioning recesses 39. Each lock lever 41 includes a lock lever first plate on a first side of an associated axle 42, with a lock lever second plate 44 positioned on a second side of the axle 42. The lock lever first plate 43 captures the spring member 40 between the lock lever first plate 43 and an associated spring positioning recess 39. The lock lever second plate 44 oriented between an axle 42 and the latch plate second side 33 is arranged to provide for reception of each of the lock lever second plates 44 within a lock plate recesses 48 directed into a lock plate 47. The lock plate 47 is slidably mounted below the axles 42 in a parallel relationship between the axles 42 and the latch plate second side 33. The lock plate recess 48 having the lock lever second plates 44 removed therefrom permit sliding movement relative to the latch plate 33 as the lock plate 47 is slidably mounted within lock plate guide loops 53. The lock plate 47 includes a lock plate first end **47*a* positioned in sliding adjacency relative to the latch plate first end 34, with the lock plate second end positioned in adjacency and sliding relationship relative to the latch plate second end 35. The lock plate second end includes an extension plate 49 orthogonally oriented relative to the lock plate extending substantially along the latch plate second end 35, with the lock plate extension plate having an extension plate projection 50 that is oriented coextensively relative to the lock plate second end 47*b*. In this manner, the lock plate and the extension plate projection 50 are directed within the container 11 and captured between the container rear wall 12 and the continuous flange 17, with the latch flange 19 positioned between the lock plate extension plate 49 and the door plate 21. Lock plate slide plates 54 are mounted in adjacency to the latch plate second end 35 to provide for a sliding surface to maintain orientation of the lock plate and extension plate relative to the latch plate 30**.

A lock plate latch lug 51 is fixedly mounted to the lock plate 47 and slidingly projects through a latch plate slot 52 that is coextensive with an in alignment with the door plate slot 27. In this manner when an individual directs a plurality of fingers through the access apertures 26 to release the lock lever second plates 44 relative to the lock plate recesses 48, the lock plate and the extension plate 49 are thereby free to slide, wherein an individual utilizes a second hand to grasp the lock plate latch lug 51 to effect its sliding relative to the latch plate slot 52 and the door plate slot 27 to thereby displace the lock plate and extension plate relative to the perimeter flange and associated latch flange 17 and 19 respectively.

Figures 9, 10:
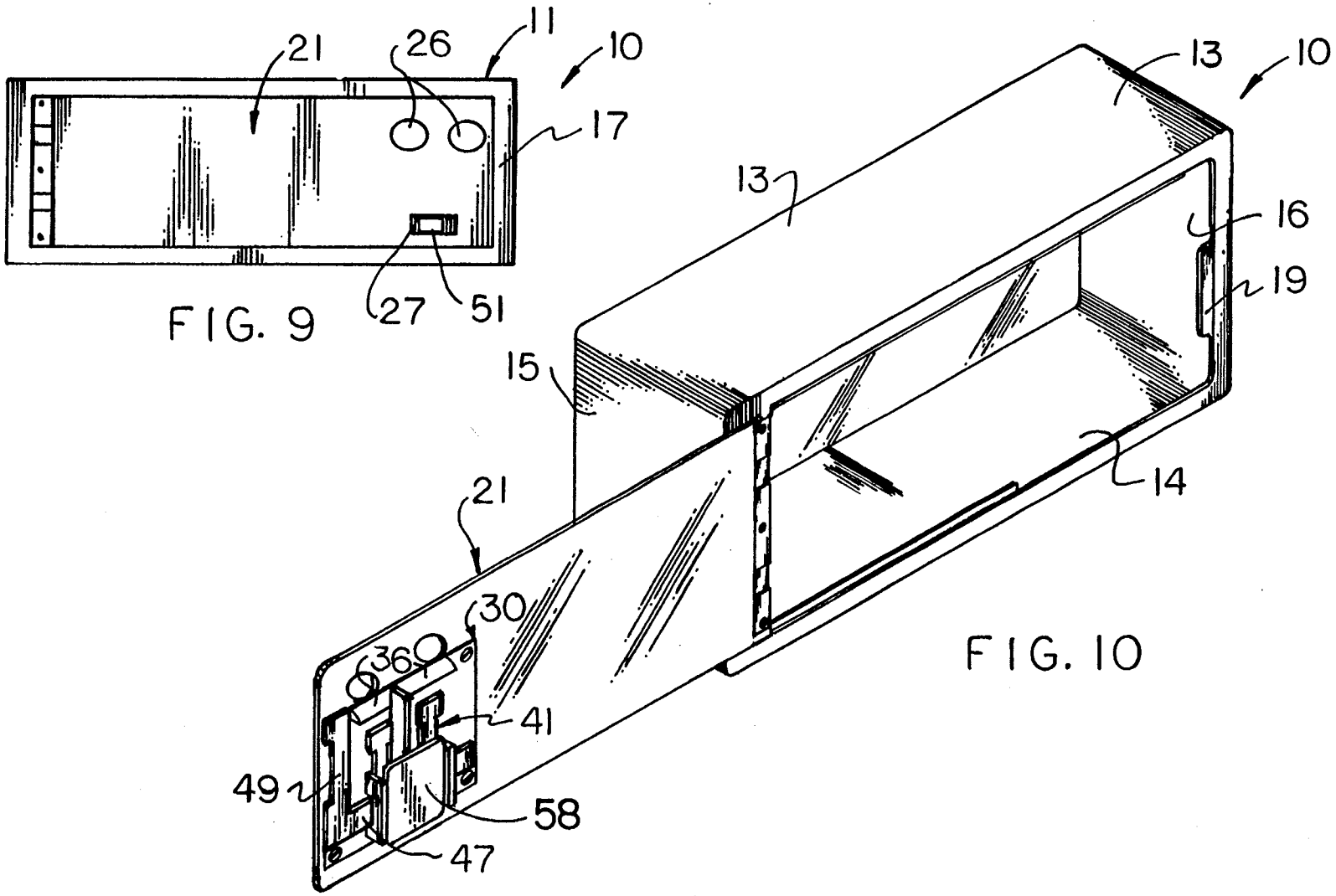
FIG. 9 is an orthographic frontal view of the housing structure.
FIG. 10 is an isometric illustration of the housing structure with the door plate unlatched relative to the container.
Figure 11:
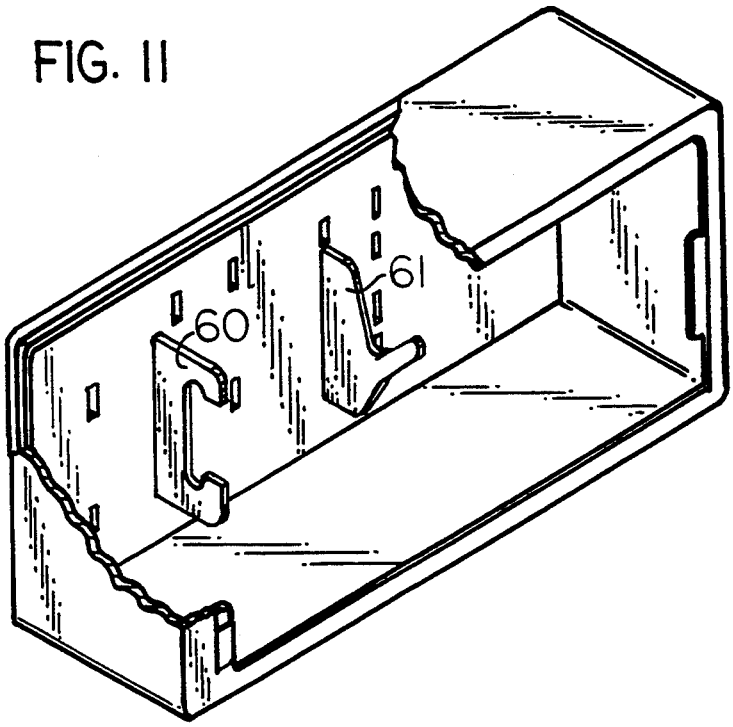
FIG. 11 is an isometric view, partially cutaway, of the cabinet structure of the invention.
Figure 12:
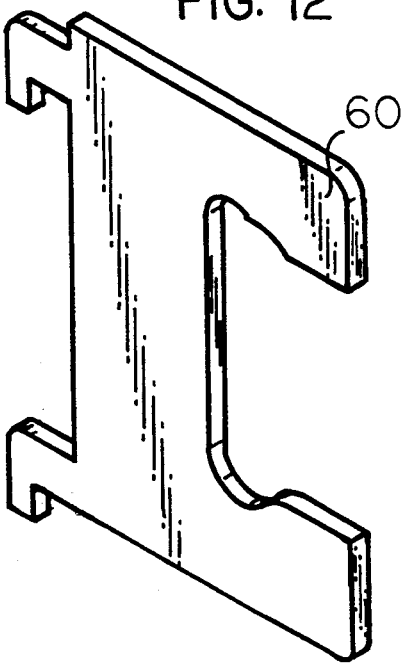
FIG. 12 is an isometric illustration of the first support hook mounted within the cabinet structure.
Figure 13:
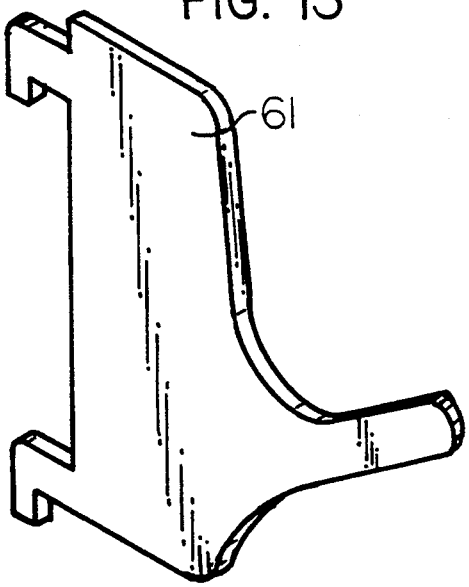
FIG. 13 is an isometric illustration of a second support hook mounted within the cabinet structure of the invention.

The FIGS. 8 and 10 indicate the use of a cover plate 58 positioned and mounted between the guide loops 53 to maintain the latch levers 41 in adjacency relative to a lock plate 30, as well as preventing unauthorized and unwarranted tampering of the latching structure.

Further it should be noted that first and second support hooks 60 and 61 are provided, with the first support hook having a C-shaped recess for receiving a gun barrel therethrough (not shown), with the second hook having a support tang projecting from the support hook to position a pistol body thereon and in this manner to provide for immediate access and grasping of the pistol upon opening of the door structure relative to the invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hand gun safety storage cabinet, comprising, a container, the container having a top wall spaced from a floor, a first side wall spaced from a second side wall, and a rear wall, with a front wall continuous perimeter flange spaced from the rear wall having a front wall opening directed through the perimeter flange, and a hinge plate mounted to the perimeter flange adjacent the first side wall, and a door plate, the door plate having a door plate first end secured to the hinge plate permitting pivoting of the door plate relative to the front wall opening, and the door plate having a door plate second end, the door plate having a door plate first side and a door plate second side spaced from the door plate first side, the door plate first side and the door plate second side extending between the door plate first end and the door plate second end, with the door plate arranged to overlie the perimeter flange in a first position in adjacency therewith, with the door plate arranged for pivoting to a second position about the hinge plate to space the door plate relative to the perimeter flange, and a plurality of access apertures directed through the door plate adjacent the door plate first side, and a door plate slot adjacent to the door plate second side oriented between the door plate second side and the access apertures, with the door plate slot spaced from the access apertures, and the door plate having an exterior surface and an interior surface, with the interior surface in a facing relationship with the container rear wall when the door plate is in the first position, and the door plate interior surface having a latch means secured to the interior surface for cooperation with the access apertures and positioned between the access apertures and the door plate second side for selective latching and delatching of the door plate relative to the perimeter flange.

2. A hand gun safety storage cabinet as set forth in claim 1 wherein the latch means includes a latch plate mounted between the access apertures and the door plate second side, with the latch plate having a latch plate first side and a latch plate second side, and the latch plate first end spaced from the latch plate second end, with the latch plate second end positioned in adjacency to the door plate second end, and a plurality of spaced guide ramps fixedly mounted to the latch plate, with one of said guide ramps positioned below one of said access apertures, and the guide ramps are canted from the latch plate first side to an orientation spaced from the latch plate oriented thereabove, and a partition wall positioned between the guide ramps and medially between the access apertures for guidance of an individual's fingers along the guide ramps, and a plurality of lock levers, with one of said lock levers positioned in adjacency to one of said guide ramps, with the lock levers positioned between the guide ramps and the latch plate second side, and a lock plate, with the lock plate slidably mounted along the latch plate, with the lock plate having lock plate recesses, and each lock lever having a lock lever first plate and a lock lever second plate, wherein each lock lever second plate is arranged for reception within one of said lock plate recesses, wherein displacement of the lock levers relative to the lock plate recesses permits displacement of the lock plate relative to the perimeter flange permitting delatching of the door plate relative to the perimeter flange.

3. A hand gun safety storage cabinet as set forth in claim 2 wherein each lock lever includes a lock lever axle, and each lock lever axle is oriented parallel to the lock plate oriented between the lock plate and the guide ramps, and each lock lever having a spring member mounted between said lock lever and the latch plate.

4. A hand gun safety storage cabinet as set forth in claim 3 wherein the lock plate includes an extension plate, and the lock plate including a lock plate second end spaced from a lock plate first end, wherein the lock plate second end is oriented in adjacency relative to the latch plate second end, and the lock plate second end includes an extension plate fixedly and orthogonally mounted to the lock plate coplanar with the lock plate, and the extension plate includes an extension plate projection coextensive with the lock plate second end for reception between the perimeter flange and the container rear wall.

5. A hand gun safety storage cabinet as set forth in claim 4 wherein the lock plate includes a lock plate slot coextensive with and aligned with the door plate slot, and the lock plate includes a latch lug fixedly mounted to the lock plate directed through the latch plate slot and the door plate slot and slidably mounted within the latch plate slot and the door plate slot.

6. A hand gun safety storage cabinet as set forth in claim 5 wherein the latch plate includes a plurality of lock plate slide plates mounted in adjacency to the latch plate second side, with the latch plate slidably mounted over one of said lock plate slide plates and the lock plate extension plate mounted over one of said lock plate slide plates to space the lock plate and the extension plate relative to the latch plate.

7. A hand gun safety storage cabinet as set forth in claim 6 wherein a first hook member and a second hook member are mounted to the rear wall, wherein the first hook member includes a C-shaped recess, and the second hook member having a tang projecting from the second hook member, wherein the C-shaped recess and the tang are arranged in a spaced parallel relationship relative to one another to accommodate a pistol therebetween in a spaced relationship relative to the floor of the container.

* * * * *